US006018327A

United States Patent [19]

Nakano et al.

[11] Patent Number: 6,018,327

[45] **Date of Patent: *Jan. 25, 2000**

[54] SINGLE-WIRE SPIRAL ANTENNA

[75] Inventors: Hisamatsu Nakano, Kodaira; Mitsuya Makino, Okegawa, both of Japan

[73] Assignee: Nippon Antena Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/945,691

[22] PCT Filed: Feb. 24, 1997

[86] PCT No.: PCT/JP97/00511

§ 371 Date: Nov. 3, 1997

§ 102(e) Date: Nov. 3, 1997

[87] PCT Pub. No.: WO97/33341

PCT Pub. Date: Sep. 12, 1997

[30] Foreign Application Priority Data

Mar. 8, 1996 [JP] Japan ..... 8-079358

[51] Int. Cl.[7] ..... H01Q 1/36

[52] U.S. Cl. ..... 343/895; 343/754

[58] Field of Search ..... 343/895, 754, 343/854

[56] References Cited

U.S. PATENT DOCUMENTS

| | | | |
|---|---|---|---|
| 2,977,594 | 3/1961 | Marston | 343/895 |
| 3,034,121 | 5/1962 | Riblet | 343/895 |
| 3,374,483 | 3/1968 | Fenwick | 343/895 |
| 3,945,016 | 3/1976 | Bizouad et al. | 343/895 |
| 3,956,752 | 5/1976 | Phelan et al. | 343/754 |
| 4,243,993 | 1/1981 | Lamberty et al. | 343/895 |
| 5,589,842 | 12/1996 | Wang et al. | 343/787 |

FOREIGN PATENT DOCUMENTS

| | | | |
|---|---|---|---|
| 58-134511 | 8/1983 | Japan . | |
| 62-216407 | 9/1987 | Japan . | |
| 4-281604 | 10/1992 | Japan . | |
| 1 390 514 | 9/1972 | United Kingdom | 1/36 |

*Primary Examiner*—Don Wong
*Assistant Examiner*—James Clinger
*Attorney, Agent, or Firm*—Pollock, Vande Sande & Amernick

[57] ABSTRACT

Taking the spiral circumference, C, of a single wire spiral antenna as 2.3 λ (λ being the wavelength at the operating frequency), for example, the beam radiated from an axis Z perpendicular to the antenna surface is tilted. The beam tilt angle changes with the spiral circumference, C, and the spiral circumference, C, is set to between 2 λ and 3 λ.

4 Claims, 6 Drawing Sheets

$\phi = 90^\circ$ (Y-Z) Plane

X-Z' Plane

Axial ratio and gain vs. frequency

SINGLE-WIRE SPIRAL ANTENNA

This application is a 371 of PCT/JP/97/00511 filed Feb. 24, 1997.

TECHNICAL FIELD

The present invention relates to a spiral antenna constituted by a single wire, and more particularly, to a spiral antenna whereby a tilted beam can be formed.

BACKGROUND ART

Communications using circular polarized waves are commonly conducted in the fields of mobile communications and satellite communications. Helical antennas and spiral antennas capable of transmitting and receiving circular polarized waves are commonly employed in communications using these circular polarized waves.

A helical antenna has maximum directivity in the direction of its helical winding axis, while a primary mode spiral antenna has maximum directivity in a perpendicular direction to the antenna surface. A secondary mode spiral antenna has bidirectional radiation characteristics.

However, in the field of communications, there are cases where a particular communications direction is required, as in satellite communications. If a specific communications direction is required the antenna beam must be set such that it matches the angle of elevation and the azimuth angle thereof.

Therefore, conventionally, the antenna is so constructed that the angle of elevation of the antenna beam can be matched to the angle of elevation of the communications direction by inclining the antenna itself, and the antenna as a whole is rotatable so that when it is mounted in a mobile station, it can be aligned with the azimuth angle of the communications direction.

However, if the antenna itself is inclined such that the beam emitted from the antenna has a specific angle of elevation, then the surface area of the antenna exposed to wind increases and it becomes necessary to strengthen the antenna fixing means. Moreover, the height of the antenna increases and there is a risk that it may exceed a maximum height when it is mounted in a mobile station.

Therefore, it is an object of the present invention to provided a single wire spiral antenna whereby the surface area of the antenna exposed to the wind can be reduced, the height of the device can be reduced, and the radiation beam of a circular polarized wave can be tilted.

SUMMARY OF THE INVENTION

In order to achieve the aforementioned object, in the single wire spiral antenna of the present invention, a single arm spiral antenna constituted by a single wire is positioned above the ground plane at a prescribed interval therefrom and, taking the wavelength used as λ, the spiral circumference of said spiral antenna is set to between 2 λ and 3 λ.

Furthermore, taking the wavelength used as λ and the spiral circumference of a single arm spiral antenna element constituted by a single wire set to between 2 λ and 3 λ, a plurality of said spiral antenna elements are positioned above a reflective plate at a prescribed interval therefrom.

In a single wire spiral antenna according to the present invention of this kind, it is possible to tilt a beam with respect to the axis perpendicular to the antenna surface, and by aligning the angle of elevation of the beam with the communications direction, the spiral antenna can be set up in a horizontal plane. Therefore, the set-up height of a spiral antenna capable of emitting a beam at a desired angle of elevation can be reduced, the surface area of the antenna exposed to wind can be reduced, and the antenna can be prevented from exceeding a height limit even when mounted in a mobile station.

Furthermore, even if an array of single wire spiral antennas of this kind is formed, a plurality of antennas should be arranged in a horizontal direction, so there is no increase in the set-up height of the spiral antenna.

DESCRIPTION OF THE PREFERRED EMBODIMENTS

Figure 1A:
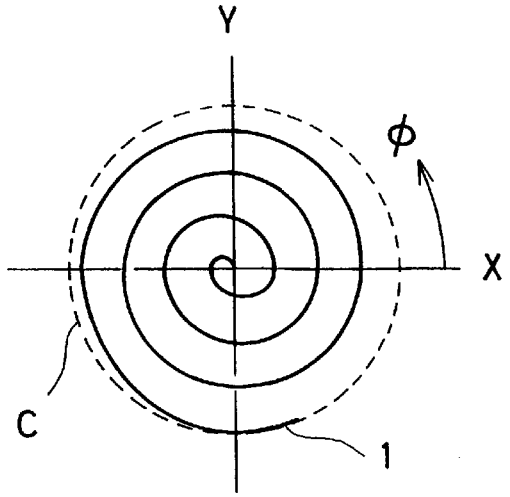
FIG. 1*a* is a top view showing the composition of a mode for implementing a single wire spiral antenna according to the present invention.
Figure 1B:
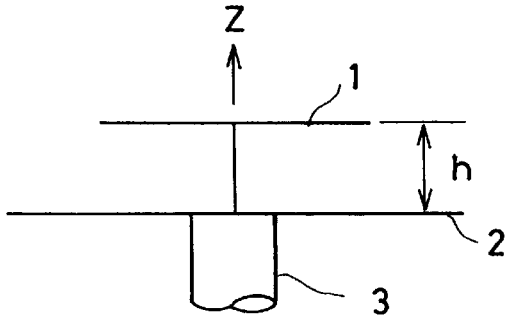
FIG. 1*b* is a side view of same.

The composition of a mode for implementing a single wire spiral antenna according to the present invention is shown is FIG. 1*a* and FIG. 1*b*. FIG. 1*a* is a top view of a single wire spiral antenna and FIG. 1*b* is a side view of same.

As shown in these diagrams, a single wire spiral antenna 1 is positioned such that the antenna surface is parallel to a ground plane 2 and separated from the ground plane 2 by an interval h. The spiral circumference, C, of this single wire spiral antenna 1 is set, for example, to approximately 2.3 λ (λ being the wavelength at the operating frequency,) and the interval h between the ground plane 2 and the single wire spiral antenna 1 is set to approximately ¼ λ.

A high-frequency signal of wavelength λ is supplied to the single wire spiral antenna 1 from a coaxial cable 3. The ground section of the coaxial cable 3 is connected to the ground plane 2, and the core wire is connected to the single wire spiral antenna 1.

Figure 2:
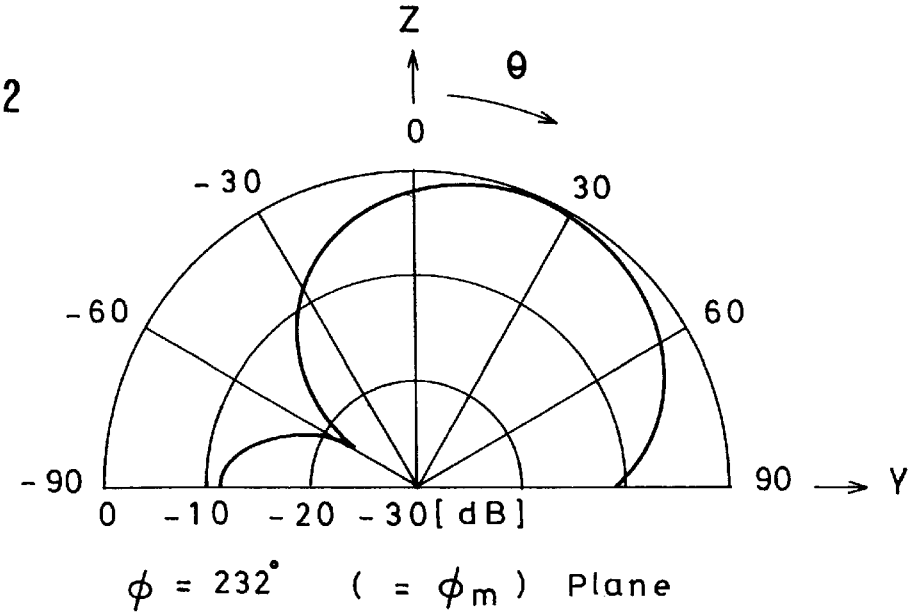
FIG. 2 shows a radiation pattern in plane Y-Z of a single wire spiral antenna according to the present invention.

FIG. 2 shows a radiation pattern in plane Y-Z of a single wire spiral antenna 1 constituted in this way, when the antenna surface of the single wire spiral antenna 1 is taken as plane X-Y and the direction perpendicular to the antenna surface is taken as the Z axis. This radiation pattern is for a plane where the angle, ϕ, shown in FIG. 1*a* is 232°, and it can be seen that a fan beam having a beam tilt angle, θ, of 28° is formed. In other words, the direction of maximum radiation of the single wire spiral antenna 1 is the direction ϕ=232°, θ=28°. The axial ratio in this case is a satisfactory figure of 1.9 dB and the gain is 8.2 dB.

In this way, the single wire spiral antenna 1 according to the present invention is able to form a fan beam which is tilted from the direction perpendicular to the antenna surface.

Figure 3:
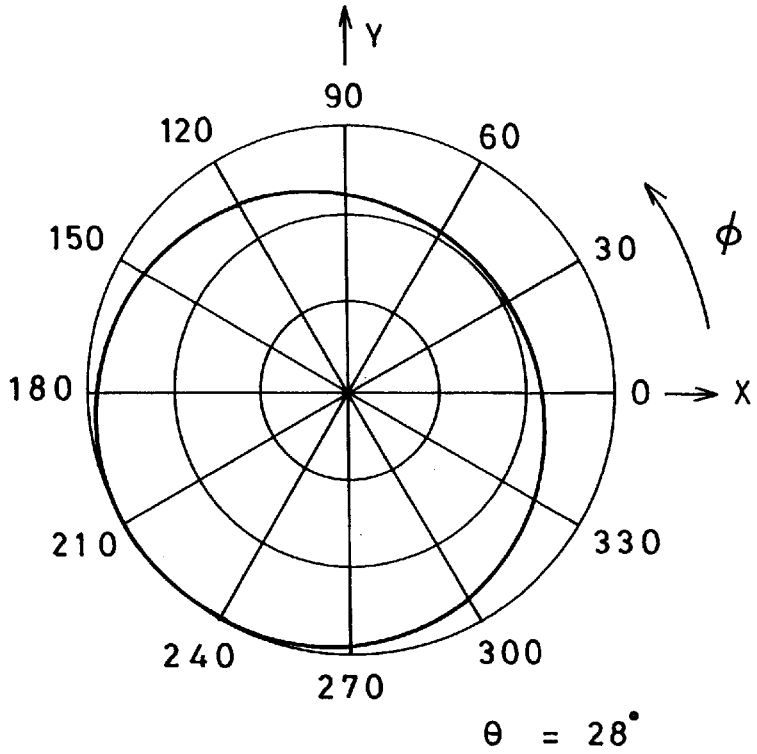
FIG. 3 shows a radiation pattern in plane X-Y of a single wire spiral antenna according to the present invention.
Figure 4:
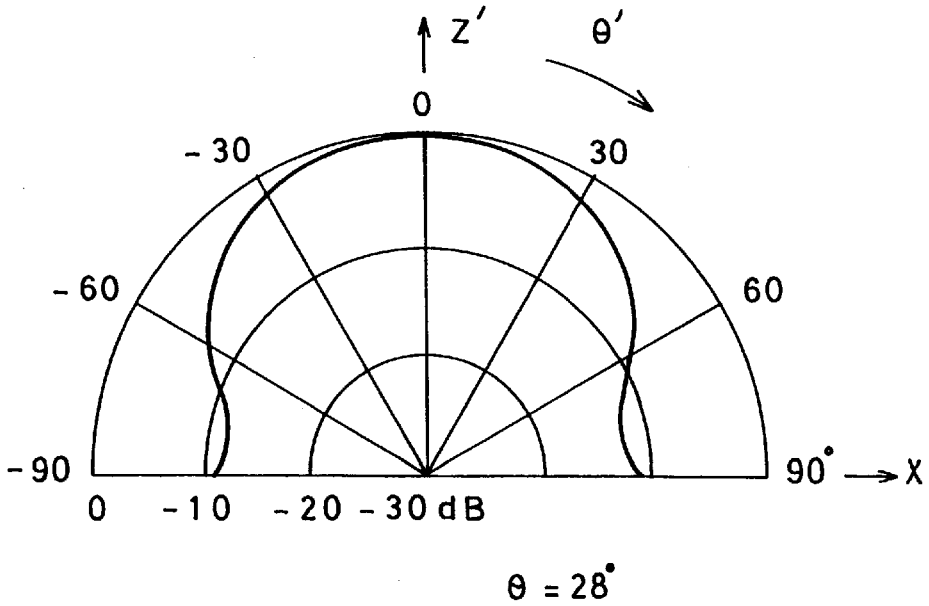
FIG. 4 shows a radiation pattern in plane X-Z' of a single wire spiral antenna according to the present invention.

A radiation pattern in plane X-Y of the single wire spiral antenna 1 is shown in FIG. 3, but here the Z axis is inclined through the beam tilt angle (θ=28°). From this radiation pattern also, it can be seen that the angle ϕ of the direction of maximum radiation is ϕ=232°. FIG. 4 shows a radiation pattern in plane X-Z' of the single wire spiral antenna 1. This Z' axis represents an axis inclined through the beam tilt angle (θ=28°).

Figure 5:
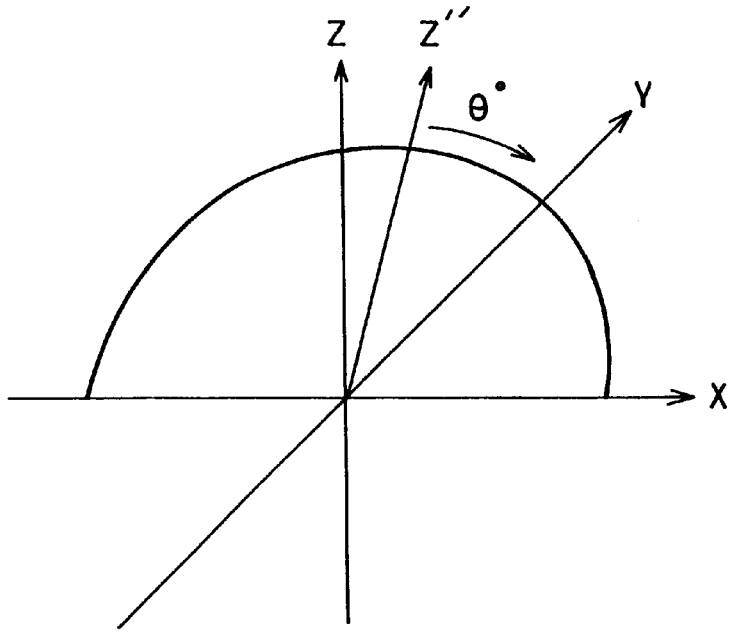
FIG. 5 shows a three-dimensional view of a radiation pattern of a single wire spiral antenna according to the present invention.

FIG. 5 shows a three-dimensional view of a radiation pattern of a single wire spiral antenna 1.

If the spiral circumference C of the single wire spiral antenna 1 according to the present invention is between 2 λ and 3 λ, then it is possible to tilt the beam formed thereby. In this case, if the spiral circumference C is changed, the beam tilt angle, θ, will also change. Furthermore, the interval h between the ground plane 2 and the single wire spiral antenna 1 is not limited to ¼ λ, but it should be in the vicinity of ¼ λ.

While the single wire spiral antenna 1 can be formed from wire, it is also possible to form a single wire spiral antenna 1 onto a insulating film, and to fix the ground plane 2 and the single wire spiral antenna 1 together by means of a dielectric such as a foamed material, or the like, positioned therebetween.

Figure 7:
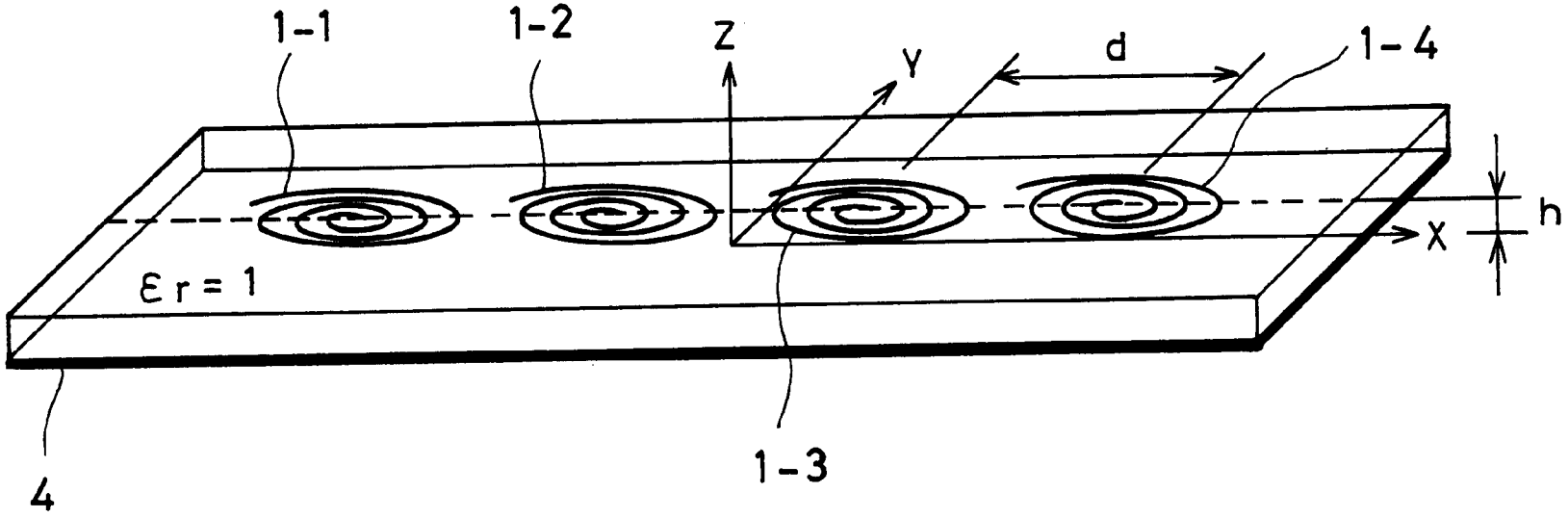
FIG. 7 shows the composition of single wire spiral antennas according to the present invention formed into an array.

Next, FIG. 7 shows the composition of a four-element array antenna using four single wire spiral antennas as illustrated in FIG. 1*a* and FIG. 1*b*.

Figure 6:
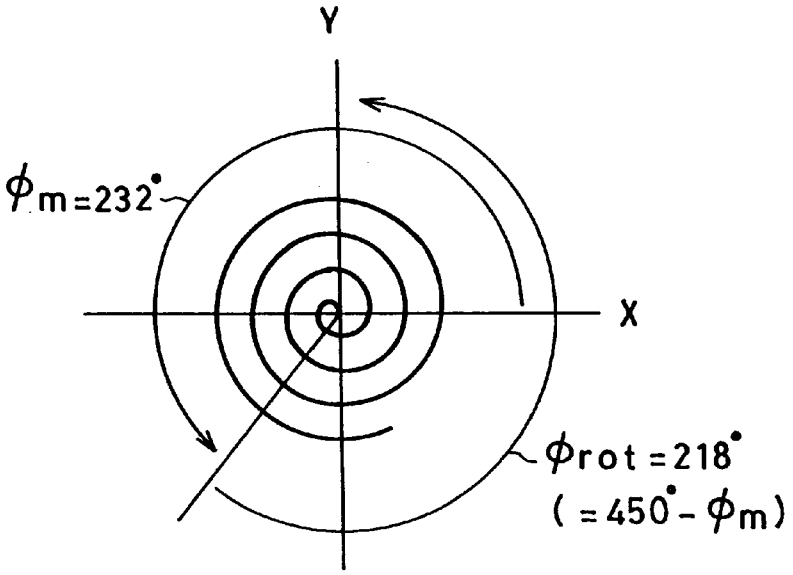
FIG. 6 is a diagram for describing single wire spiral antennas according to the present invention formed into an array.

In this diagram, 1-1–1-4 are single wire spiral antenna elements, which are arranged at an interval h above a reflector 4. In this case, the spacing d between the single wire spiral antenna elements 1-1–1-4 is set to approximately 0.8 λ, and the single wire spiral antenna elements 1-1–1-4 are rotated 218° to direction ϕ as shown in FIG. 6, such that the direction of maximum radiation of the antenna array is plane Y-Z. The interval h between the single wire spiral antenna elements 1-1–1-4 and the reflector 4 is set to approximately ¼λ.

Electricity is supplied to the single wire spiral antenna elements 1-1–1-4 by means of a coaxial cable omitted from the drawing, and the electricity supply is set such that all of the single wire spiral antenna elements 1-1–1-4 are in phase with each other.

Figure 8A:
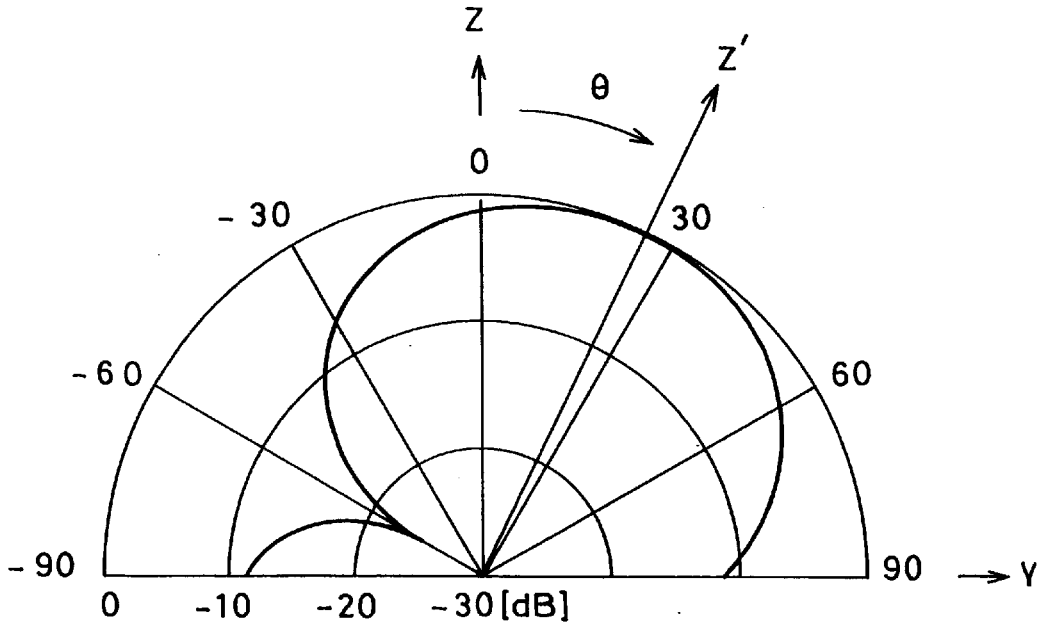
FIG. 8*a* shows a radiation pattern in plane Y-Z of single wire spiral antennas according to the present invention formed into an array.
Figure 8B:
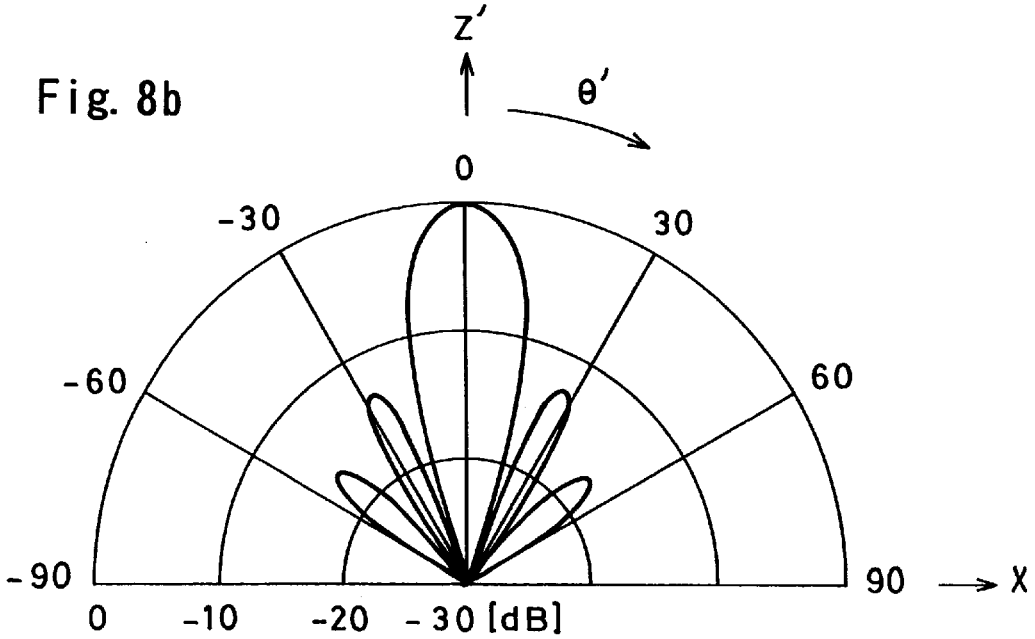
FIG. 8*b* shows a radiation pattern in plane X-Z' of same.

FIG. 8 shows radiation patterns for an antenna array composed as shown in FIG. 7. FIG. 8*a* is a radiation pattern in plane Y-Z; the beam tilt angle, θ, in the direction of maximum radiation is approximately 24°, which diverges by approximately 4° from the figure for an independent single wire spiral antenna element. FIG. 8*b* hows a radiation pattern in plane X-Z', and since the single wire spiral antenna elements 1-1–1-4 comprise an antenna array in a horizontal direction, the beam forms a pencil beam in the direction of the azimuth angle. The Z' axis is an axis inclined through the beam tilt angle (θ=24°) from the Z axis.

Figure 9:
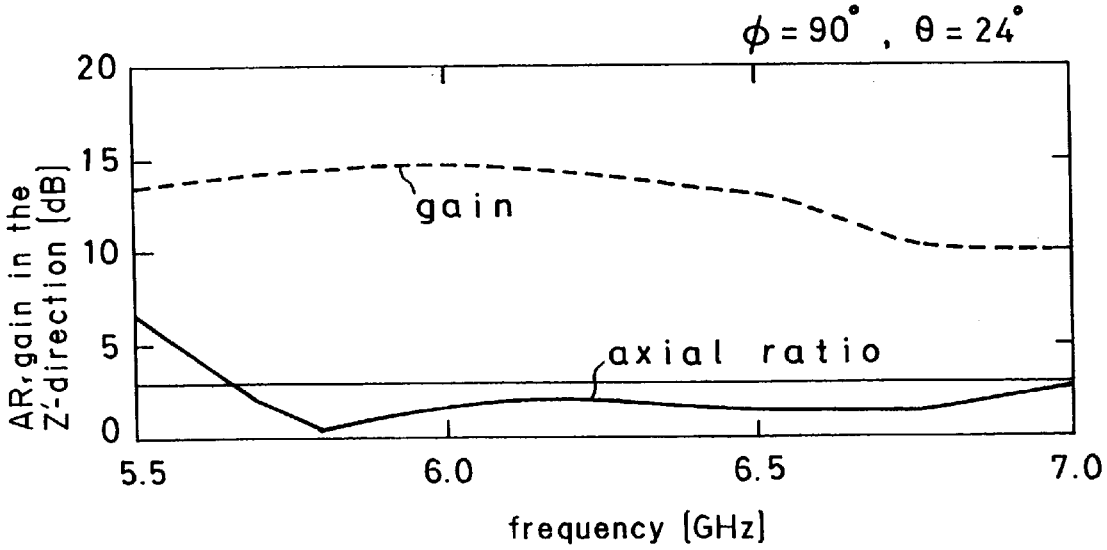
FIG. 9 illustrates axial ratio and gain characteristics with respect to frequency for single wire spiral antennas according to the present invention formed into an array.

FIG. 9 shows axial ratio and gain characteristics with respect to frequency for an antenna array constituted as shown in FIG. 7. As illustrated in this diagram, the axial ratio is a satisfactory figure of 3 dB or less across a wide frequency band from approximately 5.7 GHz to approximately 7 GHz. Furthermore, the gain is also high with a maximum gain figure of 14.7 dB, and high gain can be obtained across a wide frequency band. In particular, when the operating frequency band is taken as 5.5 GHz–7.0 GHz, the frequency bandwidth where the axial ratio is 3 dB or less with respect to the center frequency thereof is a broad bandwidth of approximately 22%.

The spiral circumference C of each single wire spiral antenna element 1-1–1-4 constituting the antenna array exceeds 2 λ but is less than 3 λ. In this case, if the spiral circumference C is changed, the beam tilt angle, θ, also changes. Therefore, the beam from the single wire spiral antenna 1 can be aligned with the communications direction by changing the spiral circumference C.

The interval h between the reflector 4 and the single wire spiral antenna elements 1-1–1-4 is not limited to ¼ λ, but it should be in the region of ¼ λ. The spacing, d, between the single wire spiral antenna elements 1-1–1-4 is not limited to approximately 0.8 λ, but it should be set such that the side lobes of the antenna array are optimized.

Moreover, as shown in FIG. 7, a space having a dielectric constant $\epsilon_r$=1 (vacuum) is formed between the reflector 4 and the single wire spiral antenna elements 1-1–1-4, but it is also possible for the reflector 4 and the single wire spiral antenna elements 1-1–1-4 to be fixed together by means of a dielectric such as a foamed material, or the like, positioned therebetween. In this case, it is preferable for the single wire spiral antenna elements 1-1–1-4 to be formed onto an insulating film.

As described above, since it is possible to tilt the beam of the single wire spiral antenna according to the present invention, it is able to form a low-profile antenna when mounted in a mobile station. Therefore, the antenna can be installed readily, and its structure is also simplified. Furthermore, since the single wire spiral antenna according to the present invention has an electricity supply point in the center of the antenna, even if the antenna is rotated within a horizontal plane, no irregularity in rotation occurs.

When antennas according to the present invention are formed into an array, the size of the antenna system increases only in a horizontal direction, and therefore such an array can be used satisfactorily even when there are restrictions in the height direction.

The frequencies cited in the description above are examples of the operating frequency of a single wire spiral antenna according to the present invention, but the device is not limited to these frequencies.

INDUSTRIAL APPLICABILITY

Since the present invention is constituted as described above, a beam can be tilted in the direction of the angle of elevation, and therefore the angle of elevation of the beam can be aligned with the communications direction, and the spiral antenna can be set up in a horizontal plane. Consequently, the set-up height of a spiral antenna whose beam is directed in a desired direction can be reduced, the surface area of the antenna exposed to wind can be reduced, and it is possible to prevent the antenna from exceeding a height limit, even when it is mounted in a mobile station.

When single wire spiral antennas of this kind are arrayed, a plurality thereof should be arrayed in a horizontal direction, such that there is no increase in the set-up height of the spiral antenna. Thereby, it is possible to prevent the antenna from exceeding height limits.

We claim:

1. An antenna for producing a beam that is tilted from a direction perpendicular to a surface of said antenna, comprising a single arm spiral antenna consisting of a single wire arranged in a circular spiral configuration extending outwards of a central axis, said single wire circular spiral configuration being located in a flat plane that is parallel to and spaced from a ground plane by about ¼λ, λ being the wavelength of the operating frequency of said single wire spiral antenna, said spiral antenna being electrically disconnected from said ground plane, said surface of said single wire spiral antenna being in said flat plane, and means for supplying a high frequency signal of wavelength λ to said single wire spiral antenna, said circular spiral configuration in said single wire spiral antenna having a spiral circumference that is greater than 2λ and no greater than 3λ.

2. The antenna of claim 1 comprising a plurality of said single arm single wire spiral antennas, each having a spiral circumference greater than 2λ and less than 3λ, disposed in fixed positions relative to one another and in coplanar spaced relation to one another in a single common plane that is parallel to and spaced from a planar reflector by a distance of about ¼λ, and means for energizing each of said plurality of fixed position single wire spiral antennas in phase with one another at said operating frequency.

3. The antenna of claim 2 wherein the space between said common plane and said planar reflector is evacuated.

4. The antenna of claim 2 wherein the space between said common plane and said planar reflector contains a dielectric material.

* * * * *